US007111676B2

(12) United States Patent
Drzewiecki

(10) Patent No.: US 7,111,676 B2
(45) Date of Patent: Sep. 26, 2006

(54) PIPE CENTERING DEVICE

(75) Inventor: Lopek Drzewiecki, Edmonton (CA)

(73) Assignee: National-Oilwell, L.P., Houston, TX (US)

( * ) Notice: Subject to any disclaimer, the term of this patent is extended or adjusted under 35 U.S.C. 154(b) by 134 days.

(21) Appl. No.: 10/816,534

(22) Filed: Apr. 1, 2004

(65) Prior Publication Data

US 2005/0217863 A1 Oct. 6, 2005

(51) Int. Cl.
*E21B 19/24* (2006.01)

(52) U.S. Cl. ..... 166/85.5; 166/78.1; 175/423; 175/195

(58) Field of Classification Search ..... 166/78.1, 166/85.5; 175/423, 195
See application file for complete search history.

(56) References Cited

U.S. PATENT DOCUMENTS 3,566,965 A 3/1971 Solum
3,575,239 A 4/1971 Solum
3,683,527 A 8/1972 Gilman
3,858,653 A 1/1975 Turbyfill
4,143,713 A 3/1979 Kreft
4,821,814 A * 4/1989 Willis et al. ..... 173/164
5,329,824 A 7/1994 Carapezza et al.
5,479,990 A 1/1996 Pepell et al.
5,595,248 A * 1/1997 Denny ..... 166/379
6,074,075 A * 6/2000 Staniec ..... 362/250

FOREIGN PATENT DOCUMENTS

EP 1 186 743 3/2002

OTHER PUBLICATIONS

EP Search Report for Appln. No. 05251634.1 dated Jan. 12, 2006 (3 p.).

* cited by examiner

*Primary Examiner*—William Neuder
*Assistant Examiner*—Nicole A Coy
(74) *Attorney, Agent, or Firm*—Conley Rose, P.C.

(57) ABSTRACT

The preferred embodiment includes methods and apparatus for locating a member within an aperture. One preferred apparatus generally includes a housing containing at least one rotatably connected ring, and a plurality of tie members spaced evenly about the ring's perimeter. The tie members are connected to the rotating ring and the housing such that rotation of the ring pulls the tie members taut across the inside of the ring. Rotating the ring in the opposite direction returns the tie members to their initial orientation. When the tie members are taut they urge elements passing through an opening towards the center. When the apparatus is installed in a drilling rig floor, it results in a simpler and more effective pipe centering technology than currently exists allowing pipe strings to be centered in the slip bowl or power slips so that the slips are easily and securely installed about the pipe string.

18 Claims, 3 Drawing Sheets

PIPE CENTERING DEVICE

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

The present invention relates to methods and apparatus for centering an elongate object passing through an opening. More particularly, the present invention relates to an apparatus for centering a pipe passing through a circular opening. Still more particularly, the present invention relates to centering a tubular in a set of slips on a drilling rig.

In rotary drilling applications, a tubular drill string is formed from a series of connected lengths of drill pipe. The individual lengths of drill pipe are joined by threaded connections. During the drilling and completion of a well, the drill string must occasionally be pulled from the well and reinstalled. The process of pulling or installing the drill string is referred to as "tripping." Other tubular strings used in well construction, such as casing and tubing strings, may also be tripped into and out of a well during drilling operations.

During tripping, the threaded connections between the lengths of drill pipe are connected and disconnected as needed. When the uppermost pipe is disconnected, the weight of the drill string is supported by slips positioned in the drill floor. Slips generally operate by inserting a wedge-shaped gripping member into the annular area between the tubular member and a fixed slip bowl. Some automatic slip assemblies operate by hydraulically engaging the tubular with a gripping member. Regardless of the configuration of the slips, almost all slip assemblies rely on the tubular being relatively centered within the assembly so that the gripping members uniformly engage the tubular.

However, due to the nature and structure of drilling rigs, the pipe string is sometimes not centered in the slips. A situation where the pipe is not centered when the slips are set can damage the pipe string and other equipment and possibly dropping of the pipe string, which can lead to delays and increased costs. Thus, it is very important to be able to center the pipe string to facilitate proper installation of the slips.

Therefore, the embodiments of the present invention are directed to methods and apparatus for centering a pipe string that seek to overcome certain of these and other limitations of the prior art.

SUMMARY OF THE PREFERRED EMBODIMENT

The preferred embodiments include methods and apparatus for centering a tubular member within an aperture. One preferred apparatus generally includes a housing containing at least one rotatably connected ring, and a plurality of tie members spaced along the ring's perimeter. The tie members are connected to the rotating ring and the housing such that rotation of the ring pulls the tie members taut across the inside of the ring, urging elements passing through the ring towards the center. Rotating the ring in the opposite direction returns the tie members to their initial orientation.

In one embodiment, the apparatus for locating an element passing through the opening of the apparatus includes multiple pieces. The first structural element, which may be a ring, has a shape in which a circle can be inscribed, and is disposed about the centerline of the apparatus opening. The first structural element may be stationary, or rotate about the centerline of the apparatus. The second structural element, which may be a ring, has a shape in which a circle can be inscribed, is disposed about the centerline of the apparatus opening, and is rotatable relative the said first structural element. The second structural element rotates about the centerline of the apparatus and relative to the first structural element. The two structural elements are then connected to a plurality of tie members, which have shape memory and may be wire cables. The tie members have one end attached to each structural element by a pivot connection. This facilitates the apparatus' two primary positions. In the first position, or resting position, the tie members do not cross the opening. However, in the second position, or active position, when the second structural element is rotated relative to the first structural element the plurality of tie members are pulled taut across the opening. This tends to urge an element passing through the opening to go to the center of the apparatus. The apparatus moves between the positions by relative rotation of the two structural elements.

In one embodiment an apparatus for aligning a body with an axis with the centerline of the apparatus is comprised of multiple pieces. The axis may also be aligned with the centerline of a well bore, power slip unit, rotary table, or slip bowl. There is a first ring that is aligned with the axis and the centerline of the apparatus, which may be attached to the apparatus such that it is stationary or rotatable about the centerline of the apparatus. A second ring with a similar size to that of the first ring is coaxial with the first ring and rotatably connected to the first ring. Three tie members are then connect between the first and second rings, which are approximately the same length as each other and approximately the length as the diameter of a circle inscribed in the rings. The apparatus then has a first position where said tie members are disposed along the circumference of one of said rings, and a second position where said tie members cross the interior of said rings. When the rings are in the second position, the tie members urge the axis towards the centerline of the apparatus.

In one embodiment a method for locating pipe in an opening comprises multiple steps. First, provide a plurality of tie members disposed about the perimeter of the opening, which have approximately the same length. Second, attach the plurality of tie members between a first structural element and a second structural. Third, rotate the second structural element in a first direction relative to the first structural element such that the plurality of tie members extend across the opening. When the tie members are pulled taut across the opening, they will urge the pipe to the center of said opening. Rotate the second structural element in the second direction, which is opposite to the first direction, and the tie members return to their initial orientation.

Thus, the preferred embodiments comprise a combination of features and advantages that enable substantial improvement in locating a tubular member within an aperture. These and various other characteristics and advantages of the embodiments of the present invention will be readily apparent to those skilled in the art upon reading the following detailed description of the preferred embodiments and by referring to the accompanying drawings.

BRIEF DESCRIPTION OF THE DRAWINGS

For a more detailed understanding of the present invention, reference is made to the accompanying Figures, wherein.

DETAILED DESCRIPTION OF THE PREFERRED EMBODIMENTS

Figure 1:
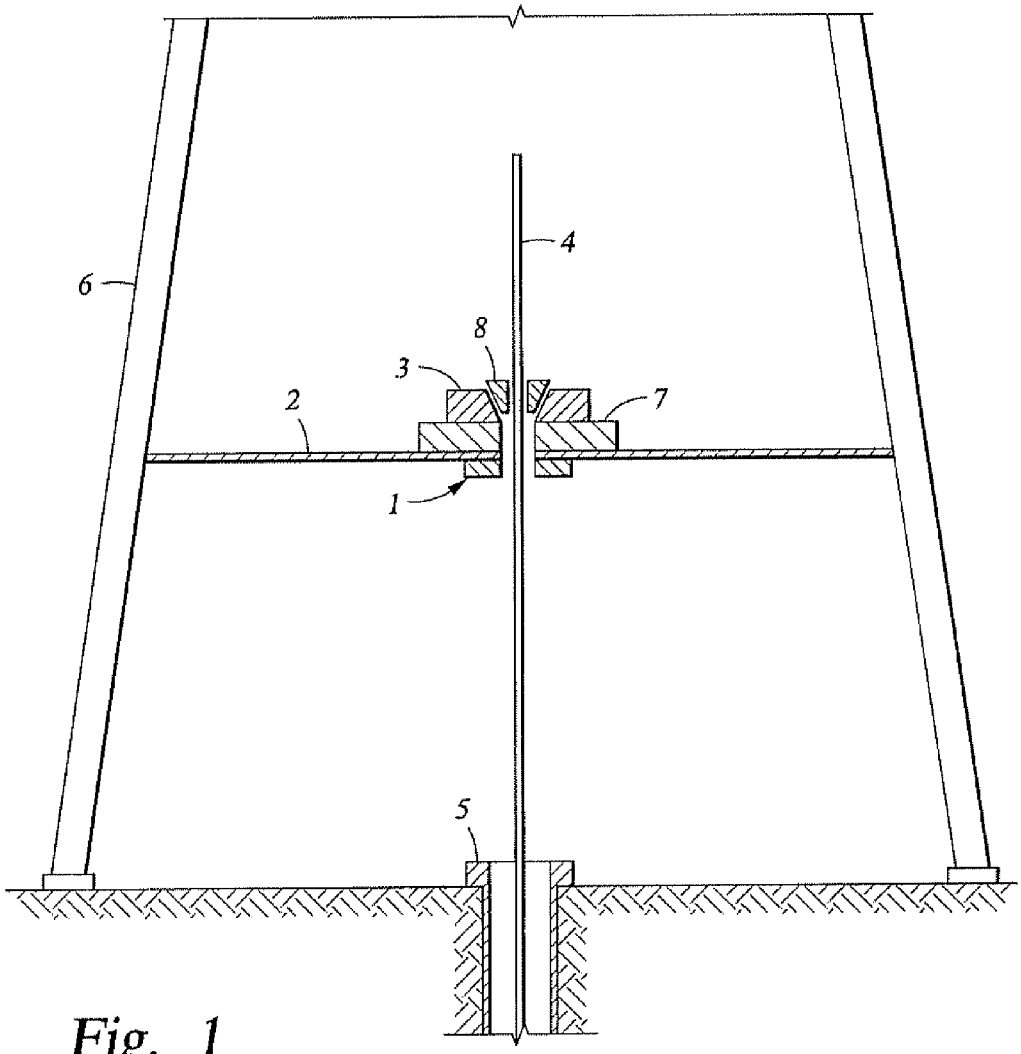
FIG. 1 is a schematic view of a drilling rig showing the general location and orientation of a pipe-centering device in reference to the drilling rig operations.

In the description that follows, like parts are marked throughout the specification and drawings with the same reference numerals, respectively. The drawing figures are not necessarily to scale. Certain features of the invention may be shown exaggerated in scale or in somewhat schematic form, and some details of conventional elements may not be shown in the interest of clarity and conciseness.

The preferred embodiments of the present invention relate to methods and apparatus for centering a pipe string in a slip assembly. The present invention is susceptible to embodiments of different forms. There are shown in the drawings, and herein will be described in detail, specific embodiments of the present invention with the understanding that the present disclosure is to be considered an exemplification of the principles of the invention, and is not intended to limit the invention to that illustrated and described herein. In particular, various embodiments of the present invention are possible. Reference is made to the application of the concepts of the present invention for centering pipe strings passing through a slip bowl on a drilling rig. However, the uses of the concepts of the present invention are not limited to these applications, and can be used for other applications, such as centering elements passing through an opening in both vertical and non-vertical orientations, or locating an element in a non-centered position. It is to be fully recognized that the different teachings of the embodiments discussed below may be employed separately or in any suitable combination to produce desired results.

Referring now to FIG. 1, pipe centering apparatus 1 is shown mounted beneath a drilling rig floor 2 about the center line of the slip bowl 3 and pipe string 4, where opening of the apparatus 1 is in line with the centerline of the well bore 5. The centering of the pipe string 4 facilitates the installation of slips 8 between a slip bowl 3 and a pipe string 4. In the preferred embodiments, the apparatus 1 is installed under a floor 2 of a drilling rig 6. The apparatus 1 is installed under the slip bowl 3 and/or the rotary-table 7 on the drilling rig 6 and inline with the pipe string 4. The slip bowl 3 is aligned with the well bore 5, and the pipe string 4 extends through the slip bowl 3 and into the well bore 5.

Figure 2:
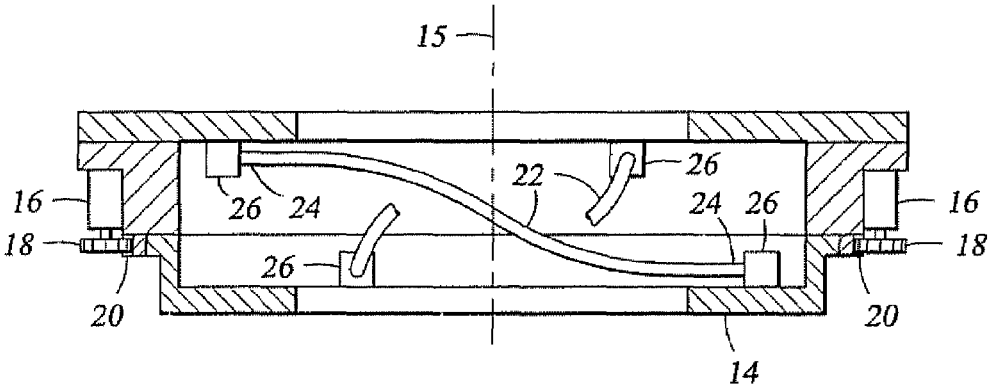
FIG. 2 is a cross sectional view of one embodiment of a pipe-centering device.
Figure 3:
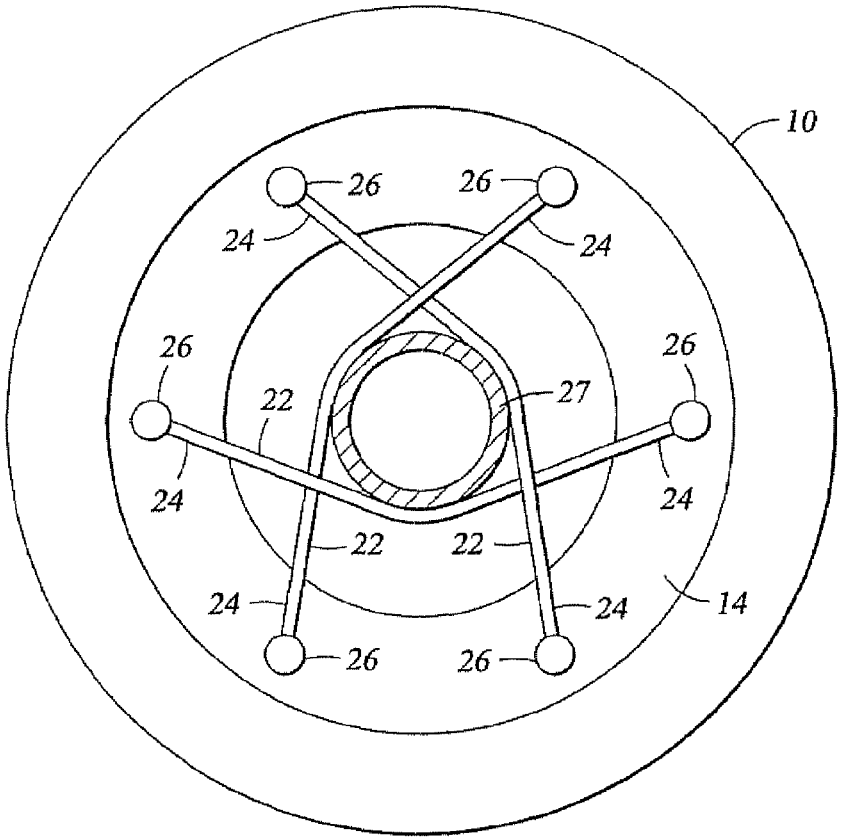
FIG. 3 is a plan view of the embodiment of FIG. 2 showing a pipe centered and the orientation of the tie members when used to center a pipe.

Referring now to FIG. 2 and FIG. 3, one embodiment of a pipe centering apparatus is shown including apparatus housing 10 enclosing chamber 12. Ring 14 is rotatably connected to housing 10 so as to rotate about axis 15 passing through the center of chamber 12. Tie members 22 are connected at their ends 24 by pivot connections 26 on chamber 12 and ring 14. Ring 14 is adapted to be rotated relative to housing 10 by one or more pneumatic, hydraulic, or electric rotary motors 16. The motor 16 is attached to apparatus housing 10 and transmits torque through pinion 18 to gear 20 fastened to ring 14.

Tie members 22 are attached inside of chamber 12 with one end attached to ring 14, and the other end attached to housing 10. The ends 24 of the tie members 22 are attached at pivot connections 26 to ring 14 and the chamber 12. Pivot connections 26 allow the ends 24 of the tie members 22 to pivot about the connection. In the preferred embodiment, three wire cables are used for tie members 22 and have terminal ends 24 spaced at 120° increments around ring 14 and chamber 12. The tie members 22 are approximately the length of the diameter of the circle formed by pivot connections 26.

In a first position, the tie members 22 are positioned substantially around the perimeter of chamber 12 and do not restrict movement through the chamber 12. To move to a second position, ring 14 is then rotated within the chamber 12. This rotation attempts to pull the tie members 22 taut, as shown in FIG. 3, across chamber 12. Tie members 22 engage pipe 27 and urge tubular member 12 towards the center of the chamber 12. As ring 14 is rotated, tie members 22 move from their first position around the perimeter of chamber 12 to their second position as shown in FIG. 3. Any pipe, tubular member, or other member that is running through chamber 12 as ring 14 rotates will be engaged by tie members 22 and urged toward the center of the chamber. Therefore, regardless of the initial position of pipe 27 within chamber 12, it will be pulled toward the center of the chamber by the engaging tie members 22.

In the preferred embodiments, tie members 22 are constructed from a flexible material, such as wire rope, that reduces damage to pipe 27 as members 22 constrict around the pipe. In the preferred embodiments, tie members 22 exhibit a shape memory, or have a natural shape that the member will assume when unloaded. This shape memory allows the preferred wire rope members to be repeatedly loaded and unloaded and still return the first position when the tension load is removed.

Figure 4:
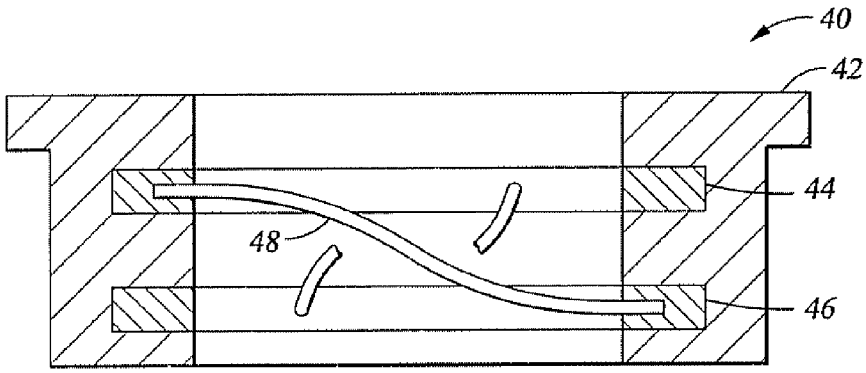
FIG. 4 is a cross sectional view of a another embodiment of the invention having multiple rings.

Referring now to FIG. 4, another embodiment of a centering device 40 is shown. Device 40 includes housing 42, upper ring 44, and lower ring 46. Connected between upper ring 44 and lower ring 46 are tie members 48. Device 40 operates in substantially the same manner as the device of FIGS. 2 and 3 but upper ring 44 and lower ring 46 rotate in opposite directions. By rotating both rings 44, 46, less angular rotation is required to actuate the device as compared to the single rotating ring 14.

Figure 5:
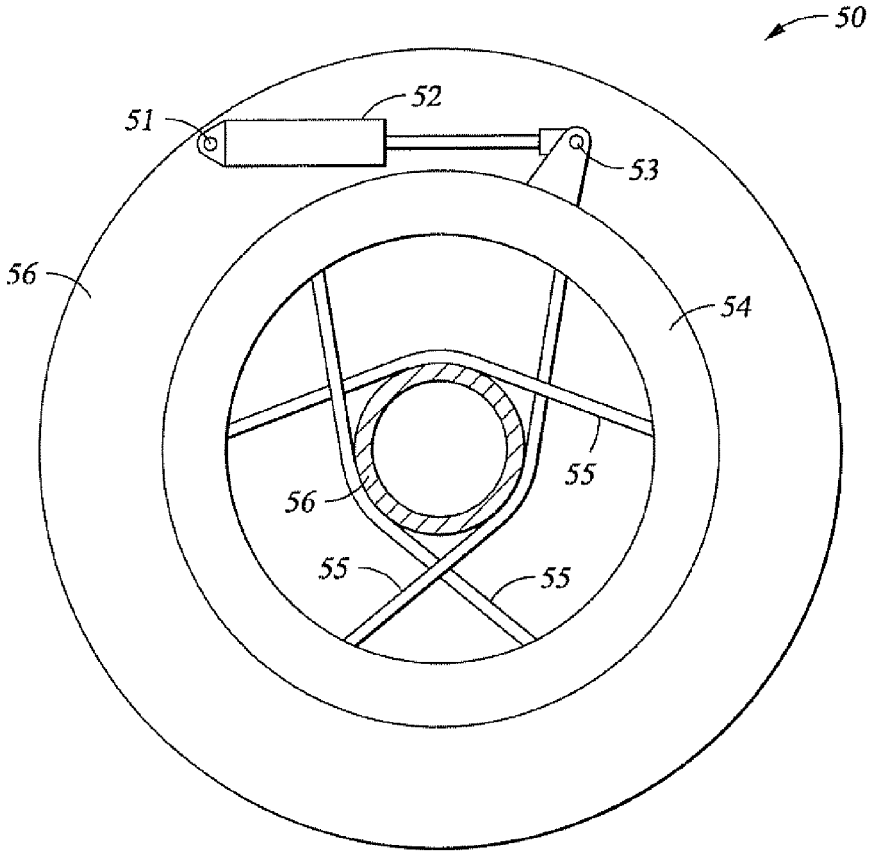
FIG. 5 is a plan view showing the use of a hydraulic cylinder for rotation of the ring of FIG. 3.

FIG. 5 illustrates a centering device 50 including an alternative drive mechanism utilizing a hydraulic cylinder 52. Cylinder 52 is fixed at one end 51 to housing 57 and at the other end 53 to ring 54. Ring 54 is mounted to housing 52 such that, as cylinder 52 extends, the ring rotates relative to the housing. As with the above described embodiments, the rotation of ring 54 pulls tie members 55 across the ring and pulls pipe 56 to the center.

Figure 6:
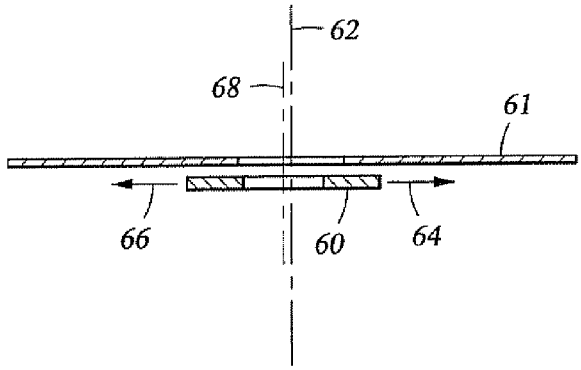
FIG. 6 is a schematic view showing the use of the apparatus for location of an element passing through an opening not centered in said opening

Referring now to FIG. 6, an alternate use of a centering device 60 is schematically illustrated. Device 60 can be moved laterally relative to axis 62 in either direction as indicated by arrows 64 and 66. In this manner, axis 68 of device 60 is offset from axis 62 through platform 61. Thus, as a tubular member is centered by device 60 onto axis 68, the member is maintained in an offset position from axis 62. Device 60 may be permanently affixed in an offset location or dynamically relocated by one or more pneumatic, hydraulic, or electric motors or hydraulic cylinders as necessary.

While the preferred embodiments use a circular ring, any shape is possible including triangles, squares, hexagons, octagons, etc., as long as a circle can be inscribed within the shape's opening.

The embodiments set forth herein are merely illustrative and do not limit the scope of the invention or the details therein. It will be appreciated that many other modifications and improvements to the disclosure herein may be made without departing from the scope of the invention or the inventive concepts herein disclosed. Because many varying and different embodiments may be made within the scope of the inventive concept herein taught, including equivalent structures or materials hereafter thought of, and because many modifications may be made in the embodiments herein detailed in accordance with the descriptive requirements of the law, it is to be understood that the details herein are to be interpreted as illustrative and not in a limiting sense.

What is claimed is:

1. An apparatus for centralizing an element within an opening, said apparatus comprising:

a first structural element disposed about the centerline of the opening;

a second structural element aligned with, and being rotatable relative to, said first structural element, wherein said first and second structural elements are positioned at a fixed distance from one another in a direction parallel to the centerline of the opening;

a plurality of tie members having a first end attached to the first structural element and a second end attached to the second structural element;

wherein said structural elements have a first position where said tie members do not cross the opening and a second position where said plurality of tie members extend across the opening.

2. The apparatus of claim 1 wherein said structural elements are adapted to move from the first position to the second position by relative rotation of said structural elements.

3. The apparatus of claim 2 wherein said first structural element is stationary.

4. The apparatus of claim 3 wherein said second structural element is rotatably connected to said first structural element.

5. The apparatus of claim 2 wherein both said first structural element and said second structural element are rotatable relative to each other.

6. The apparatus of claim 1 wherein said plurality of tie members have shape memory.

7. The apparatus of claim 6, further comprising a plurality of pivot connections connecting the end of each of said plurality of tie members to each of said structural elements.

8. The apparatus of claim 6 wherein said plurality of tie members are constructed from wire cable.

9. An apparatus for aligning a body with an axis comprising:

a first ring defining an aperture and aligned with the axis;

a second ring coaxial with and rotatable relative to said first ring, wherein said first and second structural elements are positioned at a fixed distance from one another in a direction parallel to the centerline of the opening;

three tie members connected between said first ring and said second ring, wherein a first end of each tie member is connected to said first ring and a second end of each tie member is connected to said second ring, wherein said rings have a first position where said tie members are disposed along the circumference of one of said rings and a second position where said tie members cross the aperture, wherein the length of each tie member is approximately equal to the diameter of said first ring.

10. The apparatus of claim 9 wherein the axis is aligned with the centerline of a well bore.

11. The apparatus of claim 9 wherein said first ring is attached to a stationary structure.

12. The apparatus of claim 11 wherein the stationary structure is a power slip unit.

13. The apparatus of claim 11 wherein the stationary structure is a rotary table.

14. The apparatus of claim 11 wherein the stationary structure is a slip bowl.

15. A method for locating pipe in an opening comprising:

providing a plurality of tie members disposed about the perimeter of the opening;

attaching the a first end of each tie member to a first structural element and a second end of each tie member to a second structural element, wherein said first and second structural elements are positioned at a fixed distance from one another in a direction parallel to the centerline of the opening; and rotating the second structural element in a first direction relative to the first structural element such that the plurality of tie members extend across the opening and urge the pipe to the center of said opening.

16. The method of claim 15 further comprising rotating the second structural element in a second direction relative to the first structural element such that the plurality of tie members return to a position disposed about the perimeter of the opening.

17. The method of claim 15 wherein the plurality of tie members includes three members of substantially equal lengths.

18. The method of claim 15 wherein the plurality of tie members includes three members of substantially the same length as the diameter of the circle inscribed within the opening.

* * * * *